United States Patent [19]

Weiss

[11] 3,946,941

[45] Mar. 30, 1976

[54] CENTRIFUGING APPARATUS

[76] Inventor: Gunther Weiss, 2025 SW. Briggs Court, Beaverton, Oreg. 97005

[22] Filed: Sept. 25, 1974

[21] Appl. No.: 509,233

[52] U.S. Cl. ..... 233/26; 233/1 R; 210/DIG. 24; 215/13 R

[51] Int. Cl.[2] ..... B04B 5/00

[58] Field of Search ..... 233/26, 1 R, 27; 23/292, 23/259; 215/13 R; 210/DIG. 24

[56] References Cited

UNITED STATES PATENTS

| | | | |
|---|---|---|---|
| 660,746 | 10/1900 | Bausch et al. | 23/292 |
| 2,070,672 | 2/1937 | Moczala | 215/13 R |
| 2,725,733 | 12/1955 | Davis | 215/13 R |
| 2,878,994 | 3/1959 | Anderson | 233/26 |
| 3,170,838 | 2/1965 | Archer | 233/26 |
| 3,666,171 | 5/1972 | Filz | 233/26 |

FOREIGN PATENTS OR APPLICATIONS

| | | | |
|---|---|---|---|
| 23,509 | 11/1908 | United Kingdom | 215/13 R |
| 537,126 | 4/1955 | Belgium | 215/13 R |
| 620,993 | 5/1961 | Italy | 215/13 R |

*Primary Examiner*—George H. Krizmanich
*Attorney, Agent, or Firm*—Kolisch, Hartwell, Dickinson & Stuart

[57] ABSTRACT

Centrifuging apparatus is disclosed comprising an outer sleeve with trunnion means carried externally of the sleeve for mounting it on a centrifuge. A Dewar tube fits within this sleeve and receives the sample to be centrifuged. The Dewar tube has inner and outer walls with expanses extending along the sides, and expanses closing off the bottom of the tube, and the space between these walls is evacuated. A radially outwardly flaring lip region is formed at the top of the Dewar tube, and standoffs are provided adjacent the bottom of the tube between the walls thereof, to inhibit breaking under centrifuging conditions.

9 Claims, 4 Drawing Figures

CENTRIFUGING APPARATUS

This invention relates generally to centrifuging apparatus and more particularly to a means for holding the sample being centrifuged.

In the handling of certain materials it sometimes is desirable to maintain the temperature of the material below a certain temperature to inhibit degradation. This may be illustrated by reference to the handling of samples derived from blood in medical diagnostic practice, although by indicating a specific instance of this requirement, it is not intended thereby to be limited to the particular use to which the means of the invention is employed.

When a sample is centrifuged at high speeds for a period of time, the movement of the container holding the sample through the air tends to build up heat. This is absorbed by the container and the heat absorbed tends to raise the temperature of the sample. As a consequence, refrigerated centrifuges have been developed for centrifuging materials that must maintained at a low temperture. These typically operate in an evacuated chamber to lower air resistance, and often are provided with cooling coils and the like. A refrigerated centrifuge is relatively expensive, and as a consequence out of the reach of many small laboratories.

In general terms, an object of this invention is to provide improved apparatus for centrifuging samples which must be maintained at a given temperature, which does not require the use of cooling coils or the maintaining of a vacuum environment to inhibit heat buildup.

More specifically, an object of the invention is to provide apparatus for centrifuging such samples which features an elongate Dewar tube for holding the sample, with inner and outer walls spaced from each other and the space between such walls evacuated. The tube is fitted within an outer sleeve with trunnion means carried externally of the sleeve employed in mounting the sleeve, and the tube within it, in the usual centrifuge.

A sample which is to be centrifuged frequently is confined within a container made of glass, since glass is a relatively easy material to clean and is widely used in laboratory equipment for a number of reasons. The Dewar tube of the invention preferably is made of glass, and has a special construction which inhibits breaking of the tube under the centrifugal forces that are produced as the result of high speed centrifuging. The Dewar tube of the invention has been employed with centrifuges running at speeds in excess of 3600 rpm without breakage under the centrifugal forces produced at such speeds.

A further object of the invention, therefore, is to provide a unique construction for a Dewar tube effective to inhibit breakage under the centrifugal forces produced by a centrifuge.

These and other objects will become more fully apparent as the following description is read in conjunction with the accompanying drawings, wherein.

Figure 2:
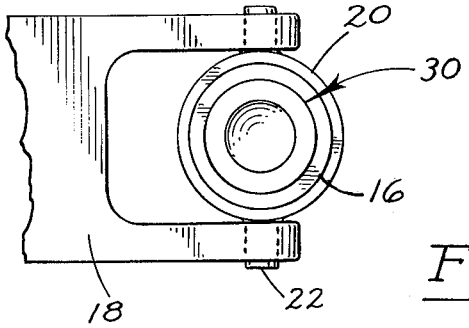
FIG. 2 is a view looking downwardly at the apparatus illustrated in FIG. 1.
Figure 1:
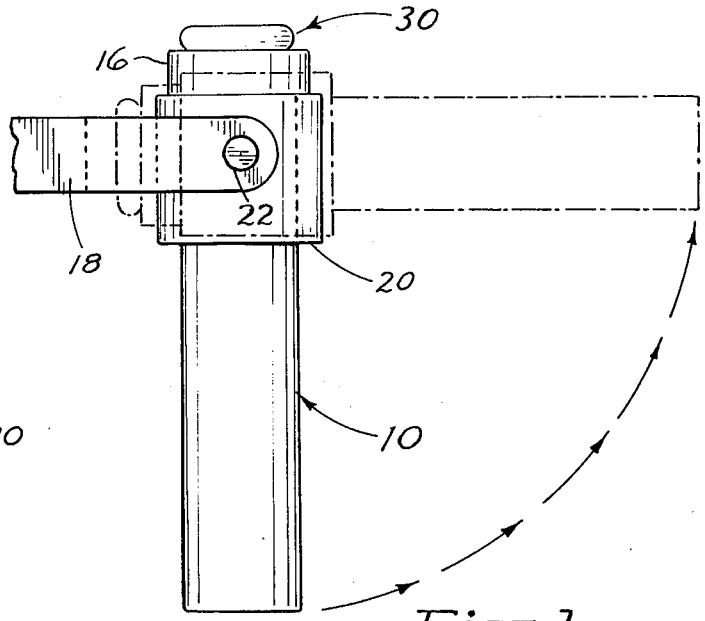
FIG. 1 illustrates portions of a centrifuge mounting through a trunnion means the combination of an outer sleeve and a Dewar tube fitted within such sleeve for holding the sample to be centrifuged.

Referring now to the drawings, the centrifuging apparatus illustrated comprises an outer receptacle or sleeve 10, which, in the particular embodiment illustrated, comprises a cylindrical wall 12, a base 14 and an annular collar 16, all of which are an integral piece. The outer sleeve is mounted on revolvable portion 18 of the centrifuge, with the sleeve inserted through a ring 20, and collar 16 in the sleeve abutting the top of this ring, as shown in FIG. 1. Trunnions 22 projecting outwardly to either side of and joined to ring 20 are journaled within portion 18. The trunnions, also referred to herein as trunnion means, thus are carried externally of sleeve 10 and in the mounting of the sleeve provide a pivot axis about which the sleeve may pivot when the centrifuge is operated, whereby the sleeve may swing from the substantially vertical position shown in FIG. 1 in solid outline to the horizontal position shown in dashed outline.

Figure 3:
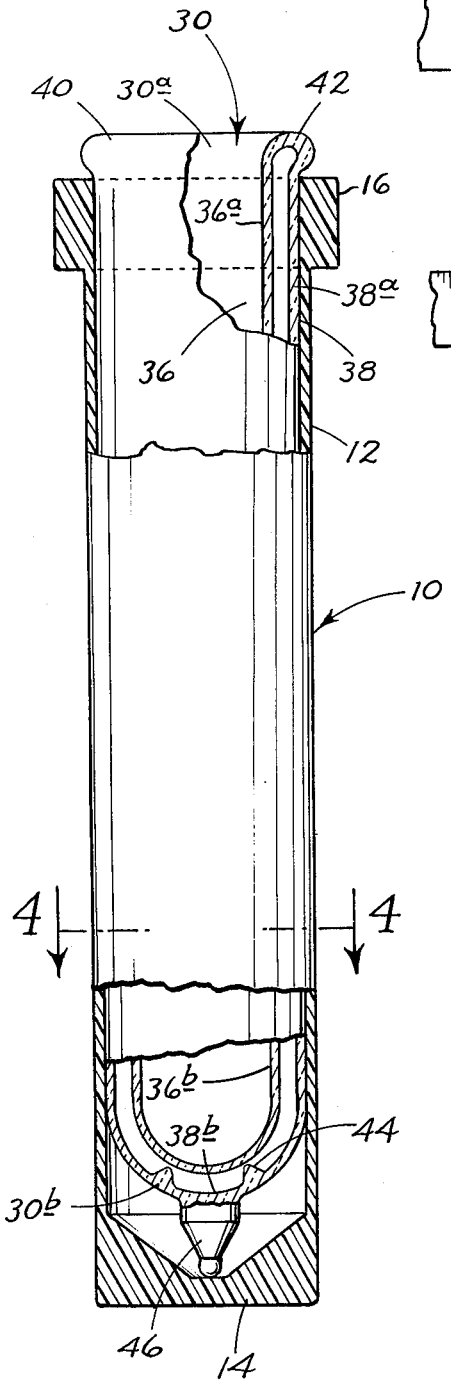
FIG. 3 is an enlarged view, partly broken away, of the outer sleeve and Dewar tube.

The sample which is centrifuged is held in a Dewar tube indicated generally at 30. With the apparatus assembled, tube 30 snugly fits within outer sleeve 10, as best illustrated in FIG. 3.

The Dewar tube, which preferably is made of glass or like material, is shaped somewhat like a test tube, and has an open top end **30*a* and a closed bottom end 30*b***. The sample to be centrifuged is introduced to the tube through the open top end, and with centrifuging separation occurs in the mass of material contained by the closed bottom end described.

The Dewar tube includes an inner wall shown at 36 and an outer wall shown at 38. The inner and outer walls throughout most of the tube extend in spaced-apart concentric cylindrical side expanses **36*a*, 38*a*. Adjacent the bottom of the tube, the walls continue in spaced bottom expanses 36*b*, 38*b* so as to close off the bottom of the tube. The inner and outer walls also join at the top of the tube, in a radially outwardly flaring lip region, shown at 40**.

The space defined between these walls is evacuated. The walls may also be silvered to obtain optimum thermal characteristics.

Considering in more detail lip region 40, and referring to FIG. 3, in this lip region, both the inner and the outer walls flare radially outwardly. They thence curve to meet each other in a zone 42 extending circumferentially about the open top of the tube. it will be noted with reference to FIG. 3 that in this zone 42 where the walls curve to meet each other, the thickness of the wall exceeds the thickness of walls 36, 38 in the expanses which extend along the length of the tube.

Figure 4:
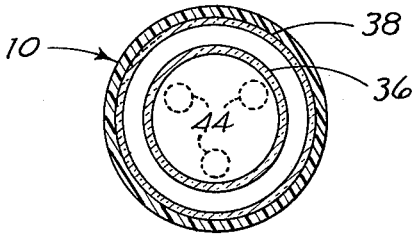
FIG. 4 is a cross-sectional view, taken generally along the line 4—4 in FIG. 3.

With reference to FIGS. 3 and 4, it will be noted that bottom expanse **38*b* of the outer wall is formed with so-called standoffs 44 distributed circumferentially about the axis of the tube. In the specific form of the invention shown, three of such standoffs are provided. These standoffs project toward bottom expanse 36*b*. Preferably, the standoffs terminate short of actual contact with the bottom expanse 36*b*. Typically, in a tube of 8 to 10 centimeter length and proportioned as indicated in the drawings, a spacing of a few thousandths of a millimeter may exist between the upper ends of the standoffs and the bottom surface of bottom expanse 36*b***.

A nipple 46 is shown projecting downwardly from the base of bottom expanse 38*b*. This is the usual nipple produced as the result of the glass blowing operation that produced the tube.

The Dewar tube is shown in FIG. 3 with the base of nipple 46 abutting the base 14 of sleeve 10. The underside of lip region 40 lies adjacent the annular collar portion 16 of the sleeve 10. Sleeve 10 may be made of a plastic material, so that under centrifuging conditions it might be said that the Dewar tube on its outside is supported in the region of its lip region and also at the base thereof.

As is well known, glass is a relatively brittle material and possesses a compressive strength which far exceeds its tensile strength. Under normal conditions, it will be seen that inner wall 36 is, in effect, suspended within outer wall 38. As a consequence, under centrifuging conditions, centrifugal force is effective to exert a force on the inner wall urging it downwardly in the tube with respect to outer wall 38.

Downward displacement of the inner wall with respect to the outer wall might normally be expected to produce breakage of the tube, more particularly a parting in the region of the tube where the inner and outer walls join at the top of the tube, by reason of the low tensile strength of glass and its inability to withstand excessive bending. That such does not occur in the Dewar tube as described is the result of the provision of the lip region 40, and standoffs 44, as will be now explained.

Referring to FIG. 3, any tendency for inner wall 36 to be displaced downwardly with respect to the outer wall is accompanied with a tendency to draw zone 42 of the lip region radially inwardly. It should be remembered that the lip region and zone 42 extend in an annular course about the top of the Dewar tube, and as a result radially inwardly directed forces in this region of the tube exerted in concert from all about the axis of the tube tends to produce compression in the lip region. This compression is absorbed by the glass, and, the compression introduces strength. By providing the bulbous lip region, therefore, a destructive bending stress is not produced at the top of the tube, but instead of a tendency for the lip region to compress and to be strengthened. Also a factor in inhibiting breakage at this region is the thickened nature of zone 42 where joinder of the inner and outer walls occur. Typically, this region may be expected to have a wall thickness which is 30 percent or more greater than the thickness of walls 36, 38 where they extend along the sides of the tube.

By providing the standoffs described, after a limited amount of displacement of the inner wall with respect to the outer wall, the clearance provided between the standoffs and the base of the inner wall is taken up, and contact of the inner wall with the standoffs occurs. At this time, there is direct support for the base of the inner wall. This support is additionally effective to inhibit tube breakage. It should be pointed out here that the standoffs are out of contact with the base of the inner wall under normal conditions, to preserve the insulating qualities of the Dewar tube, i.e., to inhibit heat loss through conduction through these standoffs.

A Dewar tube was prepared as described having a length of approximately 9 centimeters, an inner diameter of approximately 1.25 centimeters and an outer diameter of approximately 1.70 centimeters. Samples were centrifuged in the tube for periods of 10 minutes or more, at 3600 rpm. The temperature of the samples immediately prior to centrifuging was about 1°C. Centrifuging was carried out at room temperature and under atmospheric pressure conditions. The centrifuging produced an increase in the temperature of the samples not exceeding 2° C. Breakage was not a factor.

It should be apparent that while there has been described one particular embodiment of the invention, variations and changes are possible as would be apparent to one skilled in the art.

It is claimed and desired to secure by Letters Patent:

1. A centrifuge tube having an open top end and a closed bottom end, said tube comprising inner and outer walls extending along the length of the tube in spaced-apart concentric, substantially cylindrical side expanses, said walls adjacent the bottom end of the tube continuing from said side expanses in spaced bottom expanses that close off the bottom end of the tube, said walls joining at the top of the tube through a radially outwardly flaring lip region with said inner and outer walls in said lip region both flaring radially outwardly from the said substantially cylindrical side expanses of said walls and thence curving to meet each other in a zone extending circumferentially about said open top end, said zone where said inner and outer walls join being disposed radially outwardly of the outer surface of the side expanse of said outer wall, the space between said walls being evacuated.

2. The centrifuge tube of claim 1, wherein said zone where said walls curve to meet each other has a wall thickness exceeding the thickness of said walls in the side expanses of said walls.

3. The centrifuge tube of claim 1, wherein the bottom expanse of one of said walls has standoffs projecting toward the bottom expanse of the other of said walls limiting the movement of one bottom expanse toward the other, said standoffs normally being out of contact with the bottom expanse of the other of said walls.

4. The tube of claim 3, wherein the standoffs are normally out of contact with the bottom expanse of the other of said walls.

5. A Dewar tube for centrifuging samples, the tube having an open top end and a closed bottom end, said tube comprising inner and outer walls extending along the length of the tube in spaced-apart concentric side expanses, said walls adjacent the bottom end of the tube continuing in spaced bottom expanses that close off the bottom end of tube, the bottom expanse of one of said walls having standoffs projecting therefrom toward the bottom expanse of the other of said walls effective to limit the amount of movement of one bottom expanse toward the other, said standoffs normally being out of contact with the bottom expanse of the other of said walls, the space between said walls being evacuated.

6. In centrifuging apparatus, the combination of an outer sleeve and trunnion means carried externally of said outer sleeve for mounting the sleeve in a centrifuge, and a centrifuge tube fitted within said sleeve for receiving the sample to be centrifuged, said centrifuge tube having an open top end and a closed bottom end and comprising inner and outer walls extending along the length of the tube in concentric, substantially cylindrical, spaced-apart side expanses, said walls joining at the top end of the tube in a radially outwardly flaring lip region, with said inner and outer walls of said tube in said lip region both flaring radially outwardly from said substantially cylindrical side expanses and thence curving to meet each other in a zone extending circumferentially about the open top end of the tube, said zone being located above said sleeve and being disposed radially outwardly of the outer surface of the side expanse of said outer wall, said walls adjacent the bottom of the tube continuing from said side expanses in spaced bottom expanses that close off the bottom end of the tube, the space between said walls being evacuated.

7. The centrifuging apparatus of claim 6, wherein said zone where said walls meet each other has a greater thickness than said walls in said side expanses.

8. The centrifuging apparatus of claim 7, wherein the bottom expanse of one of said walls has standoffs projecting toward and normally out of contact with the bottom expanse of the other of said walls effective to limit movement of one bottom expanse toward the other.

9. Centrifuging apparatus for centrifuging samples under controlled temperature conditions comprising an element which rotated thereby to produce centrifugal force, a sleeve carried by said element to be rotated thereby, and a centrifuge tube for containing the specimen to be centrifuged mounted on said sleeve, said centrifuge tube having an open top end for receiving the sample and a closed bottom end and comprising inner and outer walls extending along the length of the tube in concentric, spaced-apart substantially cylindrical side expanses, said walls joining at the top of the tube in a radially outwardly flaring lip region with said inner and outer walls of the tube both flaring outwardly from the said substantially cylindrical side expanses and thence curving to meet each other in a zone extending circumferentially about the open top end of the tube, said zone where said inner and outer walls join being located above the top of said sleeve and being disposed radially outwardly of the outer surface of the side expanse of said outer wall, said walls adjacent the bottom of the tube continuing from said side expanses in spaced bottom expanses that close off the bottom end of the tube, the space between said inner and outer walls being evacuated to produce an evacuated space within the sides of the tube effective to prevent heat transfer whereby a stabilized temperature condition in a sample contained in the centrifuge tube tends to be maintained.

* * * * *